US006330814B1

(12) United States Patent
Fujiwara

(10) Patent No.: US 6,330,814 B1
(45) Date of Patent: Dec. 18, 2001

(54) CIRCULAR KNITTED FABRIC AND METHOD FOR FORMING ARTICLE FROM THE SAME

(75) Inventor: Toshio Fujiwara, Tokyo (JP)

(73) Assignee: Kabushiki Kaisha Miyake Design Jimusho, Tokyo (JP)

( * ) Notice: Subject to any disclaimer, the term of this patent is extended or adjusted under 35 U.S.C. 154(b) by 0 days.

(21) Appl. No.: 09/616,662

(22) Filed: Jul. 14, 2000

(30) Foreign Application Priority Data

Oct. 4, 1999 (JP) ..... 11-283001

(51) Int. Cl.[7] ..... D04B 9/42
(52) U.S. Cl. ..... 66/8; 66/121
(58) Field of Search ..... 66/8, 17, 169 R, 66/170, 171, 172 R, 175, 176, 179, 196

(56) References Cited

U.S. PATENT DOCUMENTS

| | | | | |
|---|---|---|---|---|
| 3,985,003 | * | 10/1976 | Reed | 66/196 |
| 4,095,441 | * | 6/1978 | Robinson et al. | 66/176 |
| 4,682,479 | * | 7/1987 | Pernick | 66/176 |
| 5,081,854 | * | 1/1992 | Lonati | 66/176 |
| 5,651,847 | * | 7/1997 | Loeffler | 156/71 |

FOREIGN PATENT DOCUMENTS

| | | |
|---|---|---|
| 62-37007 | 3/1967 | (JP) . |
| 62-153304 | 9/1967 | (JP) . |
| 50-12362 | 2/1975 | (JP) . |
| 52-12306 | 4/1979 | (JP) . |
| 54-11053 | 5/1979 | (JP) . |
| 57-71460 | 5/1982 | (JP) . |
| 57-87005 | 11/1982 | (JP) . |

* cited by examiner

*Primary Examiner*—Danny Worrell
(74) *Attorney, Agent, or Firm*—Pitney, Hardin, Kipp & Szuch LLP

(57) ABSTRACT

A circular knitted double fabric having an inner and outer layers which are basically separated from each other. At first group of yarn feeder knitting only by dial needles is done, while at second group of yarn feeder knitting only by cylinder needles is done. A stitching between the inner and outer layers by using both of the dial and cylinder needles is done along a closed outline of a garment. A cutting of the fabric along the closed outline is done in such a manner that the stitched parts are, at least partially left. As a result, a cutting of the fabric along the closed outline allows a garment to be separated from the fabric, which fabric has a front and back bodies, which are along its outline firmly connected with each other by the stitched parts.

2 Claims, 6 Drawing Sheets

Fig. 2A
Fig. 2B
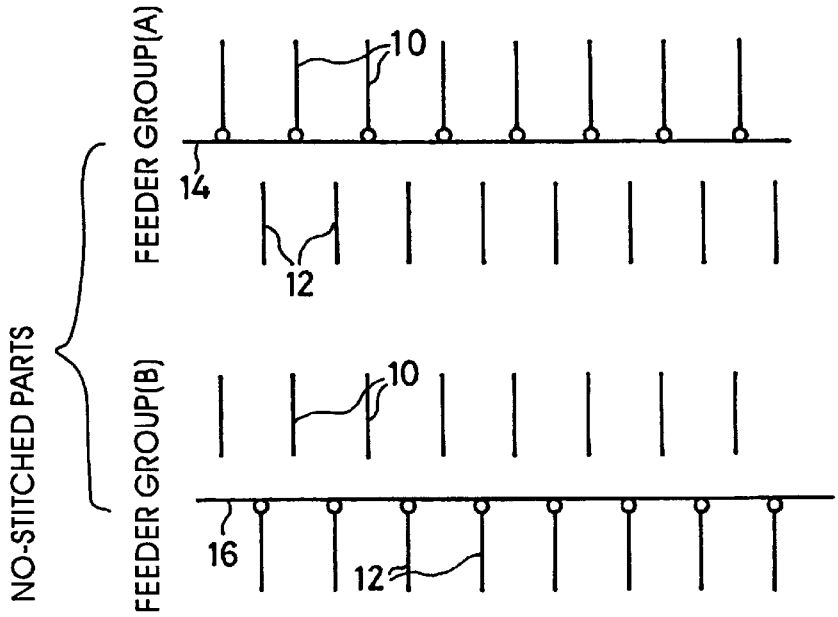
Fig. 3A
Fig. 3B
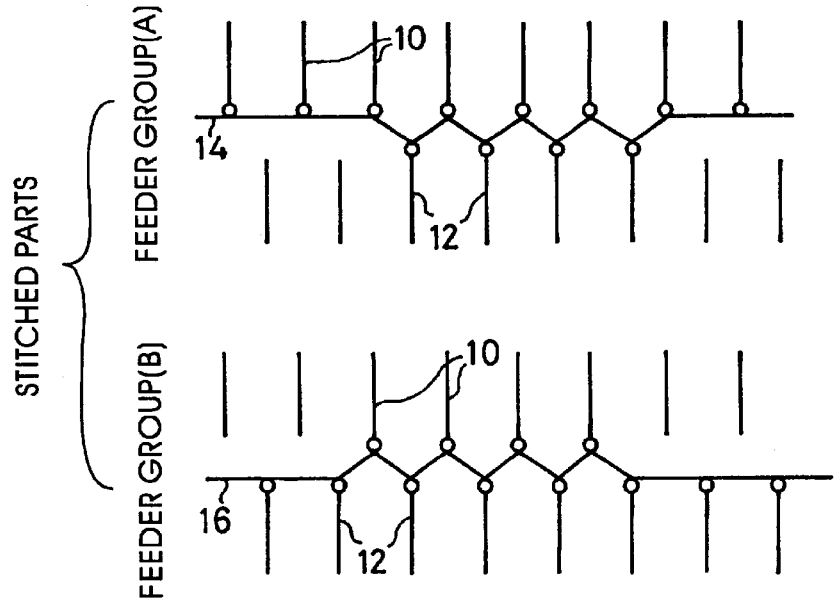

CIRCULAR KNITTED FABRIC AND METHOD FOR FORMING ARTICLE FROM THE SAME

BACKGROUND OF THE INVENTION

1. Field of the Invention

The present invention relates to a circular knitted fabric and a method for circular knitting.

2. Description of Related Art

When a garment is produced from a circular knitted fabric, a series of processes has been conventionally taken, wherein the knitted fabric is subjected to a cutting along pattern papers, thereby obtaining corresponding parts of the garment, such as a front body, a back body and a collar, et al, which is followed by a sewing by which these parts are connected with each other, thereby obtaining a garment.

In order to increase a production efficiency by an automation, a computerized system has recent been developed as far as a cutting is concerned. Namely, in this kind of system, a data base is provided for storing pattern papers in accordance with sizes, a selection of a pattern paper matched to the result of a size measurement is then done, the selected pattern paper is corrected suitably on a computer screen and a cutting of the fabric is done by using a laser cutting device. Such a laser cutting system has recently been widely used in a semi custom-made manufacture of men's garments.

As far as a sewing is concerned, an automated operation is much more difficult, and therefore a manual operation is, basically, still used. Therefore, the sewing is a bottleneck from the view point of increase in an production efficiency as well as of decrease in a production cost. Under these circumstances, there has heretofore been a strong requirement as to a development in a garment making by which any sewing is not necessary.

As far as weft knitting process is concerned, where stitched loops can be desirably laterally moved for controlling a knitting width, a garment making without sewing has been conventional from old days where only manual knitting is done. Furthermore, even a mechanical knitting is concerned, sophisticated weft knitting machines have commercially been available, where one to one independent electronic control of knitting needles is employed, thereby realizing, without sewing, a fully automated garment making, including a tying up at opened portions of the garment such as a sleeve, a collar and a hemline or base. As to this kind of weft knitting machine, refer, for example, Japanese Examined Patent Publication No.3-75656.

However, a weaving technique is completely different from a weft knitting technique. In other words, weaving technique can not, at any means, be applied to the weaving technique. The present invention aims, thus, to eliminate substantially sewing, also, in a garment making from a circular knitted fabric.

SUMMARY OF THE INVENTION

According to the present invention, a circular knitted fabric for cutting therefrom articles is provided, said fabric comprising:

an inner and an outer knitted layers which are, basically, separate from with each other, the inner knitted layer being for one side of the article while the outer knitted layer being for the other side of the article, and;

stitching parts by which the inner and outer layers are stitched along a contour line of an article so that the articles are integrated to the fabric;

said contour lines of articles as repeated patterns being distributed along substantially entire length and the width of the fabric, which, by cutting, allows the article to be separated from the fabric, while the opposite sides of the article are connected with each other along the contour line.

According to the present invention, said article is a garment, and said one side is a front body of the garment while said other is a back body of the garment.

According to the another aspect of the invention, a circular knitted fabric for cutting therefrom articles is provided, said fabric being knitted by a circular knitting machine having a series of dial needles and a series of cylinder needles, said fabric comprising:

an inner and an outer layers which are separated from each other, said inner layer being knitted by using the dial needles while said outer layer is knitted by using the cylinder needles and;

stitched parts in which, by using both of the dial needles and the cylinder needle, said inner and outer layers are stitched with each other along a contour line of the article.

According to the present invention, said article is a garment, and said one side is a front body of the garment while said other is a back body of the garment.

According to the present invention, the arrangement of the repeated patterns is such that the stitched parts which become opening of the article are run along the direction inclined with respect to a course of the circular knitted fabric.

According to the present invention, the circular knitted fabric is constructed by an inner and outer layers, which are separate with each other and which are knitted by the dial and cylinder needles, respectively. The inner and outer layers are, along an outline of an article or a garment, connected with each other by using a stitching construction using both of the dial and cylinder needles. A cutting of the fabric along the stitched line is done in such a manner that the stitched parts are at least partially remained, thereby obtaining a garment having opposite sides which are, along its outline, firmly connected with each other. As a result, according to the present invention, without fully or at least partially eliminating any sewing process, which has hereto been essential, an article or garment can be cut out from a circular knitted fabric.

The stitched parts according to the present invention is a kind of a pattern which extends substantially full width, i.e., full length of the fabric in the wales direction. Thus, the present invention can be desirably practiced by using a circular knitting machine capable of providing a large pattern. From this view point, a desirable circular knitting machine for practicing the present invention is the one which is provided with needle to needle based electronic controlled pattern selection mechanism, which makes it possible to obtain a large sized pattern extending along the full width in the wales direction.

In case of a circular knitted fabric, the cutting makes a loosening to be likely occurred. However, the inclined arrangement of the pattern makes it possible that the cutting line at the sleeve or neck extends, as long as possible, in a direction inclined with respect to the direction of the course, thereby making a loosening to be less likely.

According to the another aspect of the invention, a method for producing a garment from a circular knitted fabric is provided, comprising the steps of:

providing a circular knitting machine having a series of dial needles and a series of cylinder needles;

knitting a fabric by the circular knitting machine, which fabric has an inner and an outer layers which are separate with each other and which are knitted by the dial needles and the cylinder needles, respectively, while stitching, by using the both of the dial and cylinder needles, the inner and second layers along a contour line of the article and:

cutting the fabric along the contour line for separating, from the fabric, an article having opposite sides which are stitched along the contour line.

According to the method invention, advantages as explained with reference to the product invention can also be obtained.

Furthermore, according to the method invention, an article or garment can be obtained from a fabric without or substantially without necessitating any sewing process, which otherwise is essential, thereby reducing a production cost of an article or garment from a fabric.

BRIEF EXPLANATION OF ATTACHED DRAWINGS

FIGS. 2A and 2B illustrate knitting diagrams at non-stitched parts in the double fabric.

FIGS. 3A and 3B illustrate knitting diagrams at stitched parts in the double fabric.

DETAILED EXPLANATION OF PREFERRED EMBODIMENTS

Figure 1:
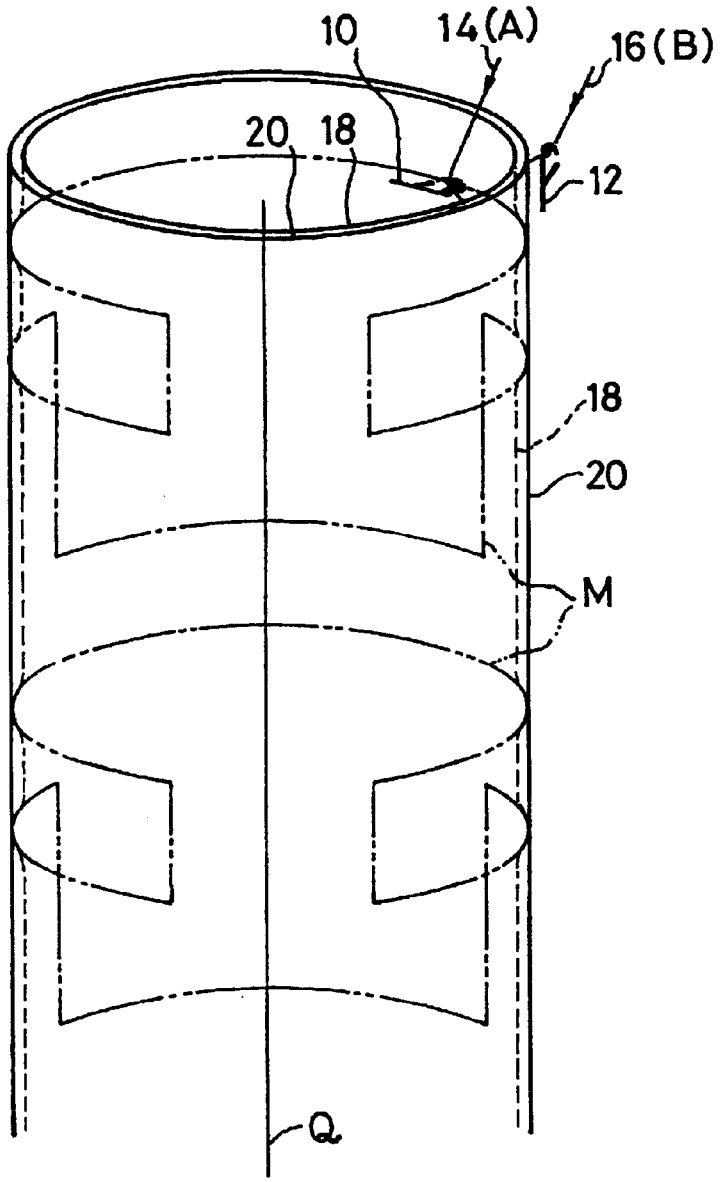
FIG. 1 is a schematic perspective view illustrating a double tube fabric according to the first embodiment of the present invention, having inner and outer tubular fabrics.

FIG. 1 illustrates schematically a formation of a circular knitted fabric as a first embodiment of the present invention, from which fabric a garment such as a sweater is obtained without necessitating any subsequent sewing process. In FIG. 10, a circular knitting machine include a series of ircumferentially spaced dial needles 10 (only one of which is shown in FIG. 1) and a series of circumferentially spaced cylinder needles 12 (only one of which is also shown in FIG. 1). In a well known manner by those skilled in this art, during a rotating movement of a cylinder of the circular knitting machine, the dial needles and cylinder needles are subjected to a horizontally radial reciprocal movement and a vertically axial movement, respectively, thereby executing a circular knitting operation.

According to the essential idea of the present invention, the circular knitting machine produces a fabric having an inner tubular layer and an outer tubular layer which are basically independent or separate from each other. The inner layer for forming one of a front body and a back body of a garment is knitted solely by the dial needles 10 while the outer layer for forming the other of the front body and the back body is knitted solely by the cylinder needles 12. These inner and outer tubular layers are stitched, under a desired width, with each other along an outline of the garment by a knitting structure which uses both of the dial and cylinder needles 10 and 12. The contour lines as repeated patters are distributed along substantially entire circumference of the circular knitted fabric. In view of this, the circular knitting machine must have a construction by which, at each thread feeding position, each of the dial needles 10 and each of the cylinder needles 12 can effect an independent needle selection control, i.e., a selective engagement of each needle with a corresponding needle lift cam. In other words, it is desirable that the circular knitting machine is the one that, at each thread feeding position, is provided with a computer controlled pattern control mechanism. Namely, for practicing the present invention, it is desirable that the circular knitting machine is of a so-called double knitting type by which an independent needle selection control is obtained at each thread feeder not only for the cylinder needles but also for the dial needles. Such a type of a circular knitting machine is, for example, available from Fukuhara Industrial Trading Co., Ltd., Osaka, Japan under the trade name of V-LEC4D. In a conventional type of knitting machine provided with a mechanical needle selection device, there is a large limit in a size of a repeated pattern, and therefore such a mechanical needle selection control type knitting machine is not practical from the view point of practicing the present invention.

In a well known manner, the circular knitting machine is provided with a plurality of yarn feeders of a number of, for example, 48 along the entire circumferential direction. According to the present invention, the yarn feeders are divided into a first group A where the yarn fed therefrom are subjected to a knitting operation basically only by the dial needles 10 and a second group B where the yarn fed therefrom are subjected to a knitting operation basically only by the cylinder needles 12. In FIG. 1, the yarns fed from the feeders in the first group A are illustrated by a reference numeral 14, while the yarns fed from the feeders in the second group B are illustrated by a reference numeral 16. Furthermore, except the knitting at the stitching portions of the desired width, at the feeders in the group A, only the dial needles 10 participate the knitting function, i.e., at the feeders in the group A, the needle selection mechanism operates for preventing the lifting cam from being cooperated with the cylinder needles 12, while at the feeders in the group B, only the cylinder needles 12 participate the knitting function, i.e., at the feeders in the group B, the needle selection mechanism operates for preventing the lifting cam from being cooperated with the dial needles 10. As a result, the execution of the knitting operation causes a double tubular fabric to be obtained, which is constructed by an inner tubular layer 18 obtained by knitting the yarns 14 and an outer tubular layer 20 obtained by knitting the yarns 16. It will be within a usual technique that the numbers of the yarns fed at the first group A and the second group B are both equal to the half of the total number of the fed yarns. However, it may possible that the numbers of the yarns fed at the first group A and the second group B are different. In the latter case, the number of courses in one repeat becomes different between the inner and outer layers.

As explained above, according to the present invention, the tubular inner layer 18 knitted solely by the dial needles 10 and the outer layer 20 knitted solely by the cylinder needles 12 are basically separated. Thus, both of the inner and outer layers 18 and 20 are of a plain stitch or its suitable combination with a tuck stitch.

In FIG. 1, a closed phantom line M indicates, in a very schematic manner, an outline of a sweater as a garment wherein one of the inner and outer layers 18 and 20 becomes one side (front body) of the sweater while the other of the inner and outer layers 18 and 20 becomes the other side (back body) of the sweater. Along the outline M of a necessary width, the inner and outer tubular layers 18 and 20 are connected or stitched with each other, so that the both of the layers 18 and 20 are integrated. As a result, when the fabric is cut outwardly along the outline while the stitched parts are at least partially left, a garment can be obtained, which has a front and back bodies, which are connected along the outline M. The stitching between the inner and outer layers along the outline M is obtained by a knitting by using both of the dial needles 10 and the cylinder needles 12. Namely, at the area of a predetermined width along the contour line M, knitting of yarns fed at the yarn feeders in the first group A is done not only by the dial needles 10 but also by the cylinder needles 12, while knitting of yarns fed at at the yarn feeders in the second group B is done not only by the cylinder needles 12 but also by the dial needles 10.

The outer line M is considered as a kind of a pattern which extends substantially entire circumference of the circular knitted fabric. It is a conventional technique that a knitting of a fabric of such a big patter is done by using a recently developed circular knitting machine provided with an electronically controlled pattern producing mechanism. Under a knitting using such a kind of a knitting machine, the pattern on a design paper is, by using digitizer, transformed into digital data, which is read out by a computer for controlling knitting machine. Based on the read out data, the computer generates control signals to the actuators for independent control of the needle selection operation for a selective engagement of each needle with a lifting cam at each yarn feeding position. Namely, a formation of control signals to the needle selection mechanism is such that, at location other than the sweater outline M, the inner fabric 18 is knitted by using only the dial needles 10 while the outer fabric 20 is knitted by using only the cylinder needles 12 and such that, at the region of a predetermined width along the sweater outer line M, the both of the dial and cylinder needles 10 and 12 participate with the knitting operation, thereby integrating the inner and outer layers 18 and 20.

FIGS. 2A and 2B illustrate, in a course direction, schematically, knitting diagrams at yarn feeders in groups A and B, respectively at the non-stitched part of the fabric. At the yarn feeder in the group A in FIG. 2A, the yarn 14 is subjected to a knitting by the dial needle 10, so that an inner tubular layer 18 (FIG. 1) is formed. In this case, the fabric is of basically a plain stitch, wherein the cylinder needle 12 does not take part in knitting operation. Similarly, at the yarn feeder in the group B in FIG. 2B, the yarn 16 is subjected to a knitting by the cylinder needle 12, so that an inner tubular layer 20 (FIG. 1) is formed. In this case, the fabric is, also, of basically a plain stitch (tenjiku), wherein the cylinder needle 10 does not take part in knitting operation. Thus, a separate structure is obtained between the inner and outer layers 18 and 20.

FIGS. 3A and 3B illustrate schematically in a course direction knitting diagrams at yarn feeders in groups A and B, respectively at the stitched part of the fabric. At the yarn feeder in the group A, the yarn 14 is subjected to a knitting by both of the dial and cylinder needles 10 and 12, so that the inner and outer layers 18 and 20 are integrated. In the example shown in FIG. 3A, the integrated fabric is of a so-called rib stitch in a rib stitch arrangement between the dial and cylinder needles 10 and 12. However, in a jacquard arrangement (not shown) of the dial and cylinder needles 10 and 12, it is possible that another desired stitching, such as birds eye, eyelet, circular rib or interlock may be employed. In the similar way, at the yarn feeder in the group B in FIG. 3B, the yarn 16 is subjected to a knitting by both of the dial and cylinder needles 10 and 12, so that the inner and outer layers 18 and 20 are integrated. Similarly, any of stitching such as bird's eye, eyelet, circular rib or interlock may also be employed. The stitching part for integrating the inner and the outer layers 18 and 20 must have a number of wale, i.e., width which may provide a strength sufficient enough for preventing the inner and the outer layers 18 and 20 from being separated.

Figure 4:
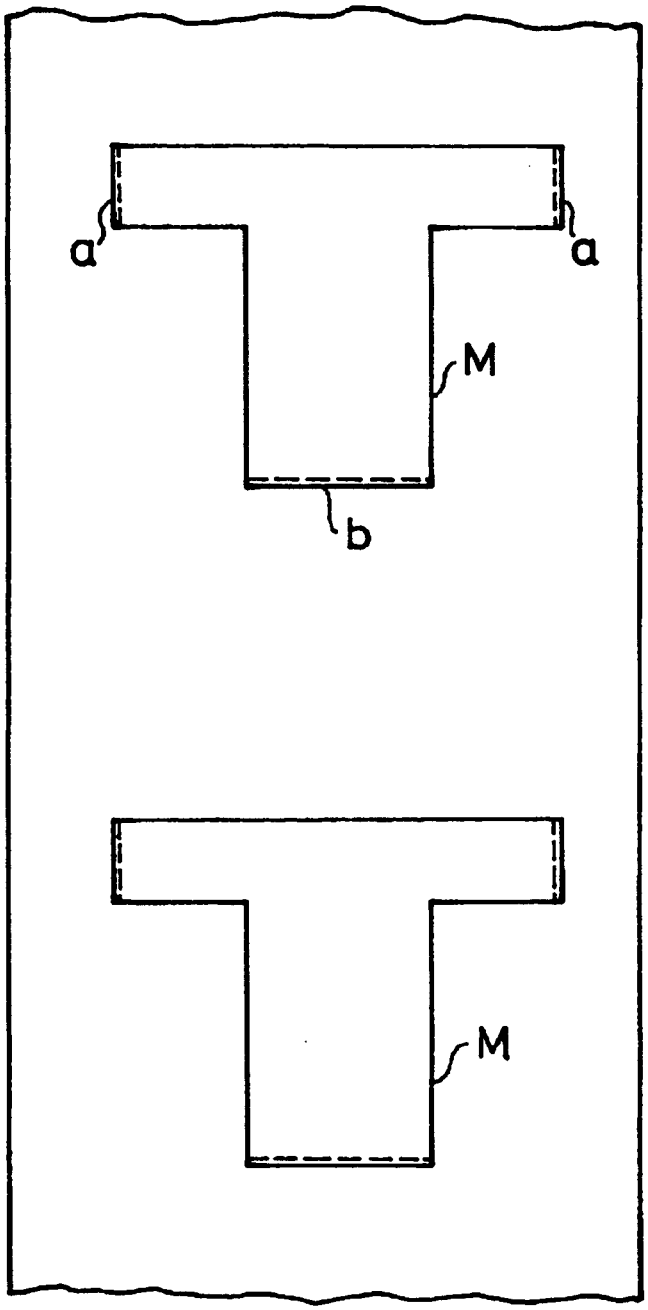
FIG. 4 illustrates, schematically, a length of the fabric after the cutting of the tubular fabric along its longitudinal direction.
Figure 5A:
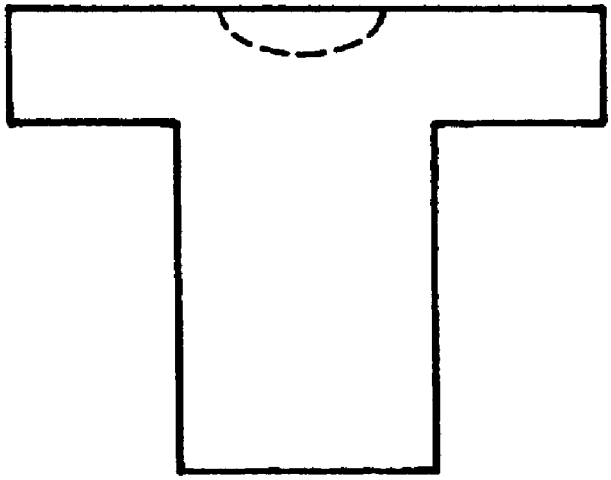
FIGS. 5A and 5B illustrate how the cutting of the fabric in FIG. 4 is done in order to obtain a garment.
Figure 5B:
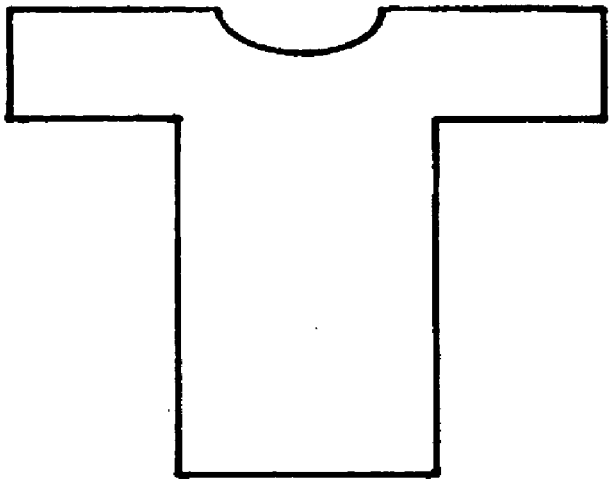

The progress of the knitting causes a circular knitted fabric of a substantially hose shape to be produced, which has closed stitched lines M as repeated patterns in the continuous length of the fabric. The fabric is cut along the longitudinal cut line Q in FIG. 1. As a result, a continuous length of a fabric having closed stitched lines M as repeated patterns as shown in FIG. 4 is obtained. Then, the fabric is subjected to a cutting along the stitching line M, while the stitched parts are at least partly remained. As a result, a garment (sweater) having a front body and a back bodies, which are stitched with each other, is obtained. In this case, the cutting at locations of the garments such as sleeves and a hemline is such that cutting lines are located completely inward of the stitched part as shown by dotted lines a and b. As a result, at these portions at the sleeve and the hemline or base, the upper and lower layers of the fabric are separated, thereby providing openings at the sleeves and the hemline, which allows portions of human body (arm and body) to be passed through the openings. FIG. 5A shows a half completed garment after cutting along the contour line. Then, cutting is further done at neck portion as shown by dotted line. FIG. 5B shows a garment after the opening at the neck portion is thus created. As a result, a garment (sweater) is obtained, in which a front and back bodies are connected with each other by the stitched portions, while the portions such as sleeve, neck and hemline for a passage of portions of human bodies are opened, without necessitating any additional sewing process. It should be noted that the garment just after separated from the fabric may be reversed. In this case, the cutting lines are completely hidden in the garment.

It is possible that the front and back body of the garment can be provided with any desired pattern (design). Namely, according to the present invention, a jacquard type circular knitting machine is used, by which the stitching along the outlines of garments as repeated patterns extending along the entire width of the fabric is allowed. Thus, there is no substantial limit as to the size of pattern to be created on the front and back bodies. In other words, on the front and back bodies, a pattern having a size extending along the entire width of the front or back body can be created. However, as to a kind of stitching to be taken, there is surely limit, since, according to the invention, the knitting of the front and back body is done by using only the dial or cylinder needles. Namely, the front and back bodies can, basically, only be of plain stitch. However, by the use of a so-called double knitting type machine where an independent needle selection is possible both at the dial and cylinder needles, a desired colored pattern can be formed both on the inner and outer layers 18 and 20 during knitting, i.e. on the front and back bodies after the execution of cutting to the garment.

Figure 6:
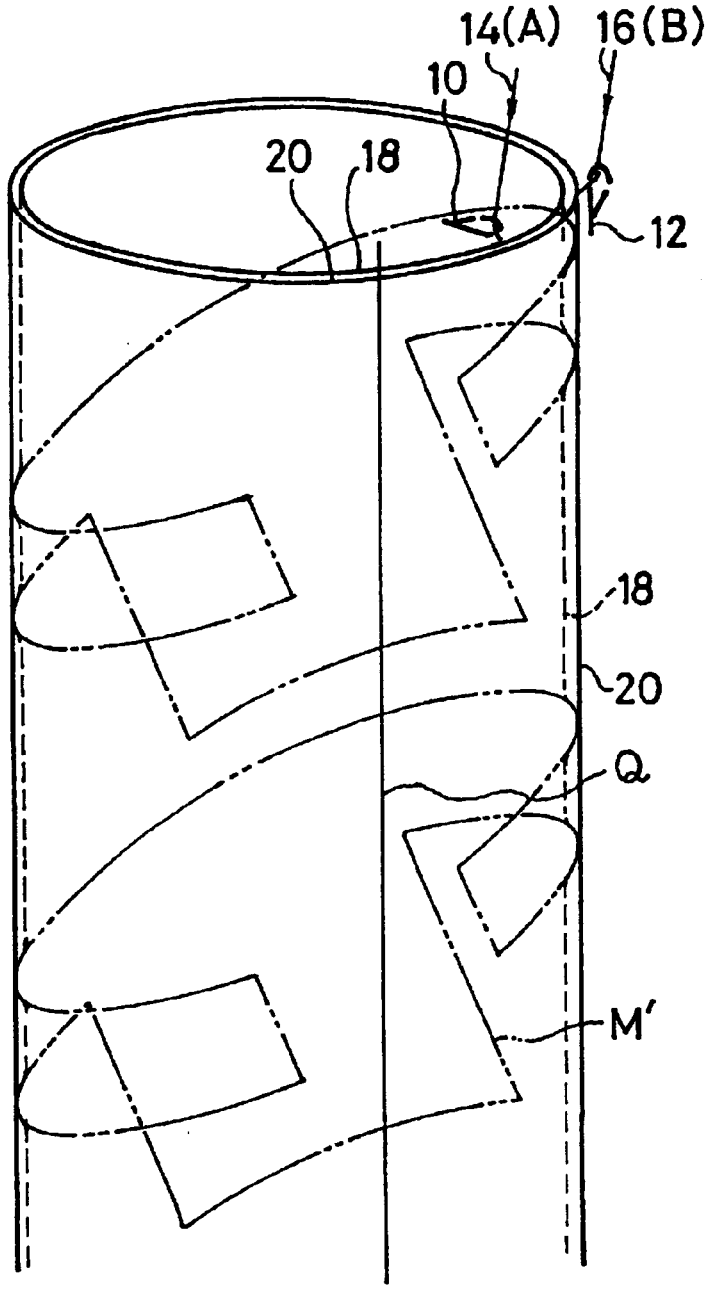
FIG. 6 is similar to FIG. 1 but illustrates a second embodiment wherein the stitched patterns on the fabric are inclined with respect to the course direction.

Furthermore, the inventor has found that a distortion is generated along the stitched part due to a slight difference in size between knitted loops at the inner layer 18 by the dial needles 10 and the knitted loops at the outer layer 20 by the cylinder needles 12. However, the inventor has found that such a distortion can be reduced by changing of twist of the yarns 14 for knitting the inner layer 18 and the yarn 16 for knitting the outer layer 20 between S and Z directions. For example, for knitting the inner layer 18, S twist yarns can be used, while, for knitting the outer layer 18, Z twist yarns can be used FIG. 6 shows a second embodiment of the present invention, wherein a patter M' as a stitched portion along a closed outline of a garment such as a sweater is inclined in such a manner that the stitched line does not, as long as possible, runs in a direction parallel to the course. In this embodiment, in accordance with the idea of the present invention, a double fabric is provided, which is constructed by a first layer 18 as a plain stitch fabric from yarns of feeders at the first group A knitted by the dial needles 10 and a second layer 20 as a plain stitch fabric from yarns of feeders at the second group B knitted by the cylinder needles 12. The inclination of the pattern M as stitched line for connecting the inner and the outer layers 18 and 20 with each other is such that the stitched line extends, as less as possible, in the direction which is parallel to the direction of the course. At the stitched portions, a knitting is done by using a stitching construction using both of dial needles 10 and cylinder needles 12, such as bird's eye, eyelet, circular rib or interlock.

Figure 7:
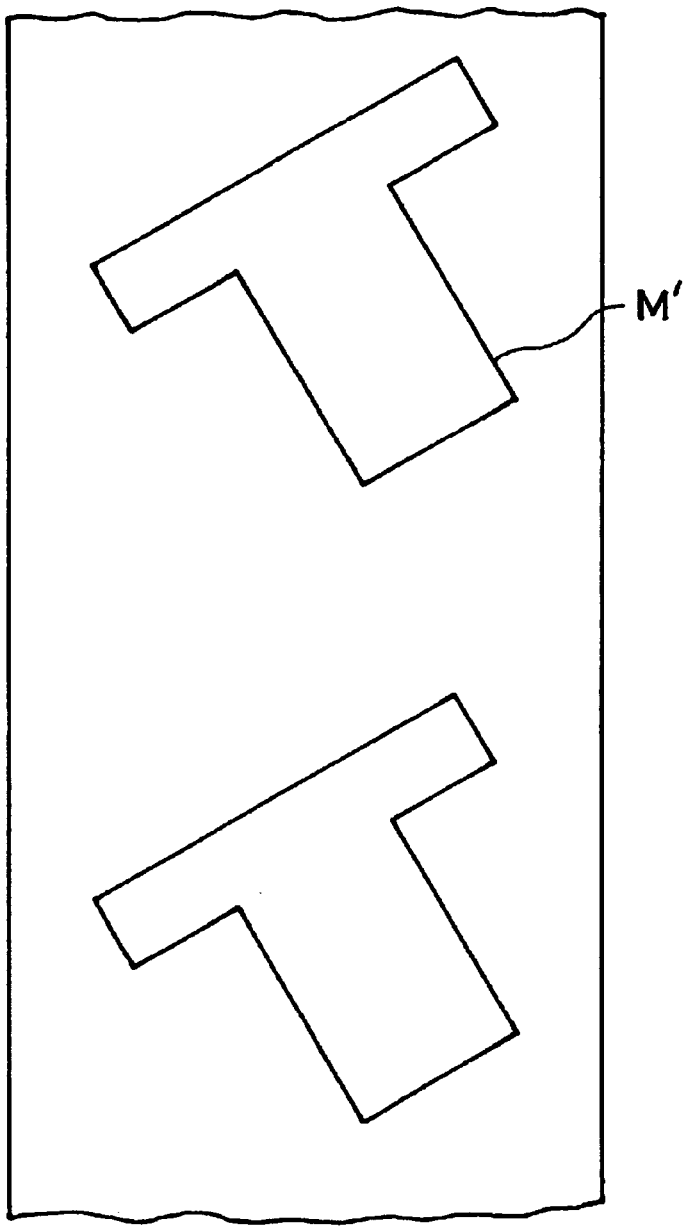
FIG. 7 is illustrate a length of fabric after the tubular fabric in FIG. 6 is subjected to a cutting along the longitudianl line.

In the second embodiment, the cutting of the fabric after completion of the knitting process is done along the longitudinal axis Q as shown in FIG. 6, so that a continuous length of a fabric as shown in FIG. 7 is obtained, wherein the pattern M' corresponding an outer profile of a garment is inclined with respect to the course direction. Cutting to a fabric is done in the similar way as in the first embodiment as explained with reference to FIG. 4 and FIGS. 5A and 5B.

In this second embodiment, the cut line along the stitched parts does not, basically, extend in a direction parallel to the course, thereby making it difficult that a loosening is occurred even at the opened portions of the garment such as sleeve and neck.

What is claimed is:

1. A circular knitted fabric for cutting therefrom garments, said fabric comprising:

an inner and an outer knitted layers which are, basically, separate from each other, the inner knitted layer being for a front body of the garment while the outer knitted layer being for the back body of the garment; and stitching parts by which the inner and outer layers are stitched along a contour line of a garment so that the garments are integrated to the fabric;

said contour lines of articles as repeated patterns being distributed along substantially entire length and the width of the fabric, which, by cutting, allows the garment to be separated from the fabric, while the opposite sides of the article are connected with each other along the contour line;

the arrangement of the repeated patterns is such that the axis of the patterns are inclined with respect to the axis of the circular knitted fabric such that the stitched parts which become opening of the article are run, as long as possible, along the direction inclined with respect to a course of the knitted fabric.

2. A method for producing a garment from a circular knitted fabric, comprising the steps of:

providing a circular knitting machine having a series of dial needles and a series of cylinder needles;

knitting a fabric by the circular knitting machine, which fabric has an inner and an outer layers which are separate with each other and which are knitted by the dial needles and the cylinder needles, respectively, while stitching, by using the both of the dial and cylinder needles, the inner and second layers along a contour line of the garment;

arranging the patterns as contour lines of the garment along the length and width of the fabric;

arranging the repeated patterns is such that the axis of the axis of the patterns are inclined with respect to the axis of circular knitted fabric such that the stitched parts, which become openings of the article after the execution of the cutting, run, as long as possible, along the direction inclined with respect to a course of the knitted fabric, and:

cutting the fabric along the contour line for separating, from the fabric, a garment having opposite sides which are stitched along the contour line.

* * * * *